United States Patent [19]

Malaval

[11] Patent Number: 4,784,415

[45] Date of Patent: Nov. 15, 1988

[54] LOCKING AND UNLOCKING DEVICE

[75] Inventor: Jean Luc P. A. Malaval, Vigneux sur Seine, France

[73] Assignee: Fichet-Bauche, France

[21] Appl. No.: 17,698

[22] Filed: Feb. 24, 1987

[30] Foreign Application Priority Data

Feb. 24, 1986 [FR] France ..... 86 02517

[51] Int. Cl.[4] ..... E05C 17/56; E05C 1/12

[52] U.S. Cl. ..... 292/144; 292/DIG. 62; 292/150; 70/282

[58] Field of Search ..... 292/144, DIG. 62, 150, 292/174, 169; 70/280, 281, 282

[56] References Cited

U.S. PATENT DOCUMENTS

| | | | |
|---|---|---|---|
| 188,308 | 3/1877 | Sherman | 292/DIG. 62 |
| 966,780 | 8/1910 | Thomas | 292/DIG. 62 |
| 1,920,080 | 7/1933 | Jenkins | 70/282 |
| 1,948,217 | 2/1934 | Goodwin | 70/282 |
| 2,178,313 | 10/1939 | Rossiter, Jr. et al. | 292/DIG. 62 |
| 2,765,648 | 10/1956 | Hatcher | 70/264 |
| 3,288,524 | 11/1966 | Gordon | 70/264 |
| 4,021,065 | 5/1977 | Geringer | 70/281 |
| 4,501,203 | 2/1985 | Lyngstrup | 292/144 |

FOREIGN PATENT DOCUMENTS

| | | | |
|---|---|---|---|
| 456440 | 6/1913 | France | 70/282 |
| 1041439 | 10/1953 | France . | |
| 2534392 | 4/1984 | France | 292/144 |
| 4863 | of 1909 | United Kingdom . | |
| 12941 | of 1911 | United Kingdom . | |
| 144476 | 6/1920 | United Kingdom | 70/282 |
| 1137760 | 12/1968 | United Kingdom | 292/150 |

*Primary Examiner*—Gary L. Smith
*Assistant Examiner*—Eric K. Nicholson
*Attorney, Agent, or Firm*—Steinberg & Raskin

[57] ABSTRACT

A device for locking and unlocking any member, comprising a bolt slidably mounted within a body and having a rear part and a front part to co-operate with a notch provided in said member in which a first electromagnet operates with its core in the bolt, the rear part of which may co-operate with the core of a second electromagnet to hold the bolt against motion within the body in a locked position on the member or in an unlocked position.

4 Claims, 4 Drawing Sheets

18
17
20
R3
9
21
8a
12
10
4
3
R1
2
1
15
8
16
R2
11
13

18
R1
21
20
R3
17
7
12
R2
10
4
3
9
2
1
8
15
16
8a
11
13

18
R1
21
20
R3
17
7
12
R2
10
4
3
9
2
1
8
15
16
8a
11
13

LOCKING AND UNLOCKING DEVICE

BACKGROUND OF THE INVENTION

The present invention relates to a device for locking and unlocking any member such for instance as a bar carrying bolts likely to co-operate with keepers, bolt-clasps or like bolt-staples or latch-catches for locking a door for instance.

Systems operated by an electric current for controlling lock bolts are already known.

It has thus already been proposed to fit doors with an electric keeper co-operating with a conventional bolt or spring-bolt. More specifically, the keeper is fitted with a small movable shutter or retainer which would retract or move aside under the action of the electric current and would release or disengage the bolt accordingly.

This system suffers from drawbacks. At first it would consume a certain amount of electric energy to the extent where the shutter or retainer of the keeper has to be kept electrically energized for some time necessary to the unlocking. Moreover, the locking of the spring-bolt within the keeper is not positive since this spring-bolt is acted upon by a simple spring and may therefore be easily picked and withdrawn from the electric keeper.

There are also locking and unlocking systems comprising a conventional bolt slidably mounted within a body and operated by an electromagnet allowing this bolt to move into and out of a keeper. This system however also exhibits the same kind of inconveniences.

As a matter of fact, the bolt which may consist of the core of the electromagnet would generally result in an electromagnet construction which is oversized and which has to be acted upon for a long time by the electric current to allow the bolt to move out of the keeper, thereby requiring a relatively substantial consumption of electric power. Furthermore, like the electric keepers, there is no positive locking of the bolt in the locked position so that is possible by means of a tool to readily actuate this bolt forming the core of the electromagnet in order to move the same out of its keeper. Finally and in case of a technical hitch resulting for instance from the bolt becoming jammed within the keeper, thereby preventing its retraction or also from the misalignment of the bolt with the keeper whereby its insertion into the said keeper would be prevented, it is understandable that the electromagnet would be kept energized by the user for a very long time in an attempt to nevertheless carry out the locking or unlocking operation which could lead to the electromagnet being damaged or even being put out of working order.

SUMMARY OF THE INVENTION

The object of the present invention is to cope in particular with the above-mentioned drawbacks by provided a device which requires a very low consumption of electric current only and which in addition, ensures a positive locking of the bolt in the locking or unlocking position.

For that purpose, the object of the invention is a device for locking and unlocking any member and of the type comprising at least one bolt slidably mounted within a body or casing and actuated by an electromagnet allowing this bolt to co-operate or not with a keeper-like notch or the like formed in the said member, characterized in that it comprises a second electromagnet co-operating with the other or first electromagnet to act positively upon the bolt in order in particular to lock it within the body or casing when it is in a position corresponding to its position of insertion into the keeper or in a position corresponding to its position moved out of or retracted from the said keeper.

According to another characterizing feature of the invention, the bolt consists on theone hand of a rear part co-operating with the core of the second electromagnet and, on the other hand, of a front part likely to co-operate with the keeper and mounted in relatively movable relationship with respect to the rear part.

It should be pointed out that the rear part of the bolt comprises on its periphery two spaced annular recesses or grooves co-operating with the core of the second electromagnet.

According to still another characterizing feature of this invention, the front part of the bolt consists of a hollow element in which is slidable a rod carrying at its free end a stop for a first spring surrounding the rod and constantly urging the hollow element towards a position bearing against the stop, this rod being made fast with and extending through the rear part of the bolt and forming the core of the first electromagnet.

According to still a further characterizing feature of the device according to the invention, a second spring surrounds the aforesaid rod and is in bearing engagement with and between the rear part of the bolt and the end wall of the body or casing in which the bolt is slidable.

A third spring is also provided for constantly urging the core of the second electromagnet towards the rear part of the bolt.

According to still another characterizing feature of this invention, the first electromagnet is secured externally onto the body in coaxial relationship therewith whereas the second electromagnet is externally secured onto the body so that its core extends at right angles to the centre line axis of the body and through a bore formed within the said body and opening towards the rear part of the bolt.

It should be pointed out that both electromagnets are electrically connected so that they may be electrically energized and de-energized selectively in accordance with the sequence of operations to be performed in order in particular to release, operate and lock the bolt within the body.

BRIEF DESCRIPTION OF THE DRAWINGS

The invention will be better understood and further objects, characterizing features, details and advantages thereof will appear more clearly as the following explanatory description proceeds with reference to the accompanying diagrammatic drawings illustrating by way of a non-limiting example only a presently preferred specific embodiment of the invention and wherein:

All the FIGS. 1 to 11 are views in axial section of the device according to the invention and illustrate various operating stages of this device;

More specifically, FIGS. 1 to 4 show the successive steps allowing the device to change from the locked condition to the unlocked condition whereas

DESCRIPTION OF THE PREFERRED EMBODIMENTS

Figure 1:
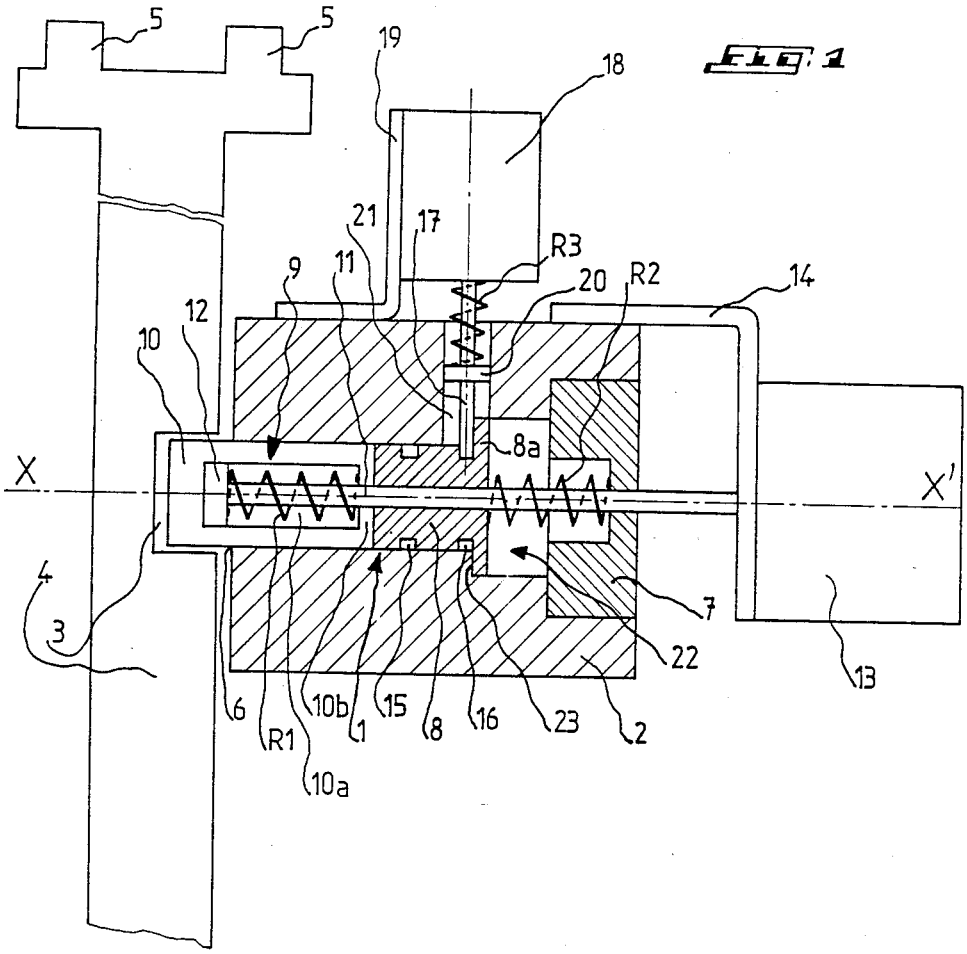

On all these Figures, the same elements which are designated by the same reference characters are shown in different positions, respectively. Therefore, FIG. 1 should alone be referred to for the purpose of describing the structure of the device according to the present invention and shown as a magnified view.

This device essentially comprises a bolt 1 slidably mounted within a body or casing 2 and likely to co-operate with a notch 3 forming a keeper provided in any member such for instance as a bar 4 carrying bolts 5 allowing through operation of the bar 4 the door of a safe or strong-box for instance to be locked or unlocked.

The body 2 comprises at one of its ends an opening 6 allowing the bolt 1 to extend therethrough and is closed at its other end by a removable end wall portion 7.

The bolt 1 consists of a sleeve-like rear part 8 and of a front part 9 likely to co-operate with the keeper 3 and mounted in relatively movable relationship with respect to the rear part 8. The rear part 8 and the front part 9 of the bolt 1 are slidably mounted within the body 2.

More specifically, the front part 9 of the bolt 1 consists of a hollow element 10 in which is slidably arranged a rod 11 provided at its free end with a stop 12 which is slidable within the bore 10*a* of the hollow element 10. A first spring $R_1$ surrounding the rod 11 and accommodated inside of the bore 10*a* abuts on the one hand the stop 12 and, on the other hand, the rear portion 10*b* of the element 10 through which the rod 11 extends. Thus, as it is understandable, the spring $R_1$ constantly urges the hollow element 10 to bear against the stop 12 of the rod 11. It should be noted that the rear portion 10*b* of the hollow element 10 would normally be in bearing engagement with the rear part 8 of the bolt 1.

The rod 11 is secured to and extends through this rear part 8 and forms the core of a first electromagnet 13 externally fastened onto the body 2 through the agency of a lug or the like 14 and in coaxial relation to the centre line axis X—X' of this body.

A second spring $R_2$ surrounds the rod 11 and is bearing on the one hand, against the rear portion or heel 8*a* of the part 8 and, on the other hand, upon the end wall portion 7 of the body 2.

The rear part 8 of the bolt 1 assumes somewhat the shape of a sleeve and comprises two outer spaced annular grooves 15 and 16. Both grooves 15 and 16 may co-operate with the core 17 of a second electromagnet 18 fastened on the side of the body 2 through the medium of a lug 19 for instance.

A third spring $R_3$ mounted about the core 17 is bearing on the one hand upon the body of the electromagnet 18 and, on the other hand, upon a ring or the like 20 integral or made fast with the core 17 and slidable within a bore 21 formed through the wall of the body 2 and opening towards the rear part 8 of the bolt 1. The bore 21 hence the core 17 of the electromagnet 18 extend in a direction orthogonal to the centre line axis X—X' of the body 2 and this centre line axis also is that one of the bolt 1 consisting of the rear part 8 and of the front part 9 which co-operates with the keeper 3.

The grooves 15 and 16 of the rear part 8 could of course consist of recesses of any shapes likely to co-operate with the core 17 of the second electromagnet 18 and this without leaving the scope of the invention.

The body 1 comprises an axial cavity 22 in which the bolt 1 is slidable. At 23 has been shown a shoulder formed within the cavity 22 and which limits the forward stroke of the rear part 8 of the bolt 1 under the action of the compression of the second spring $R_2$. In effect, as it is well seen on FIG. 1, the heel 8*a* of the part 8 is abutting the shoulder 23 involved thereby corresponding to the inserted position of the front part 9 of the bolt 1 into the notch 3 of the bar 4.

Having thus described the structure of the device according to the invention, its operation will now be explained.

Figure 2:
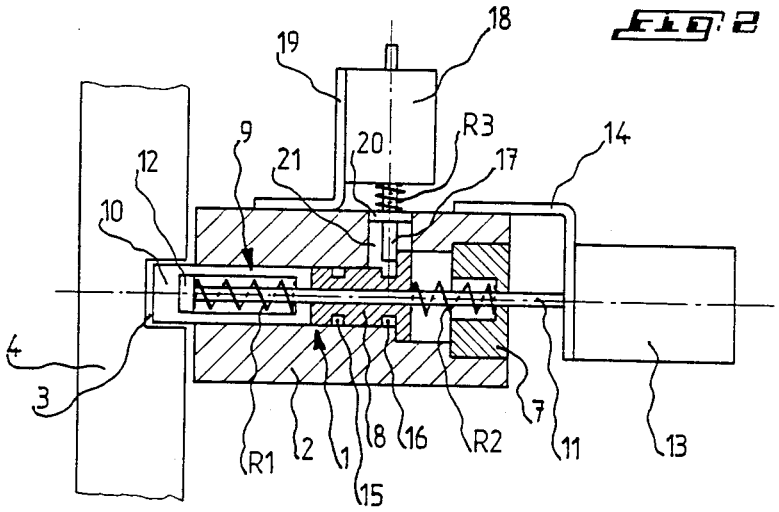
Figure 3:
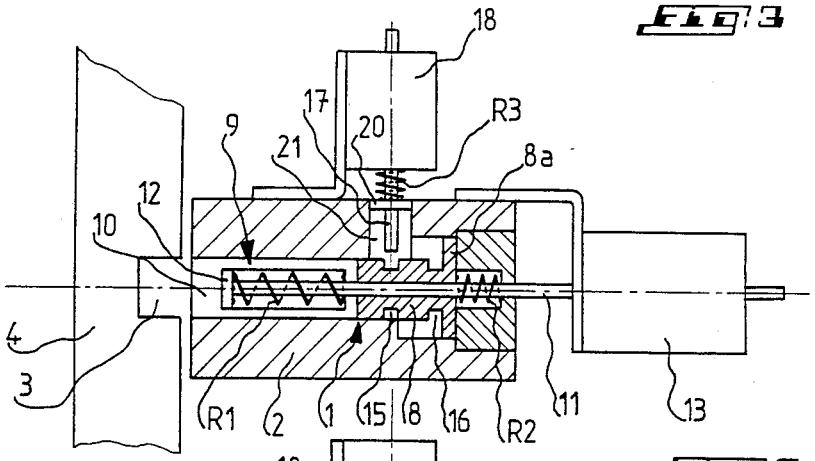
Figure 4:
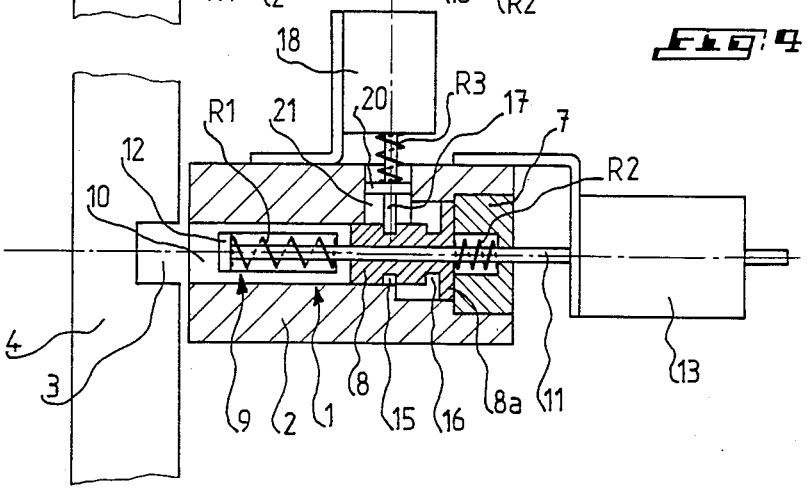

It should at first be started from the locking position shown on FIG. 1 to explain how the unlocking occurs with reference to FIGS. 2 to 4.

As seen on FIG. 1, the bar 4 is locked by the front portion or part 9 of the bolt 1. The front part 9 is prevented from moving out of the keeper 3 by the presence of the rear part 8 the groove 16 of which receives the core 17 of the electromagnet 18. In that position, the system is at rest and the electromagnets 13 and 18 are not energized.

Through energizing of the electromagnet 18 and as well seen on FIG. 2, the core 17 is lifted against the force of the spring $R_3$ which is compressed. The rear part or sleeve 8 of the bolt 1 is thus set free or disengaged.

While keeping the electromagnet 18 energized, the electromagnet 13 is then energized thereby causing the rod 11 forming the core of the electromagnet 13 to move backwards as seen on FIG. 3. Then the system consisting of the rear part 8 and of the front part 9 both constituting the bolt 1 is displaced until the heel 8*a* of the part 8 is engaging or abutting the end wall portion 7 of the body 2. In this position seen on FIG. 3, the front portion 9 of the bolt 1 is withdrawn or retracted from the keeper 3 and the spring $R_2$ is compressed.

The energizing of the electromagnet 13 is maintained and the energizing of the electromagnet 18 is switched out or discontinued. Then, the return spring $R_3$ biassing the core 17 of the electromagnet 18 causes this core to move downwards into the groove 15 of the rear part 8 of the bolt 1. The bar 4 is thus unlocked and the bolt 1 is locked within the body 2 as well seen on FIG. 4. Under these circumstances, it is possible to switch out or discontinue the supply of the electromagnet 13 with electric current. In other words, the bolt 1 is locked in the retracted position within the body 2 and the bar 4 may move freely.

Figure 5:
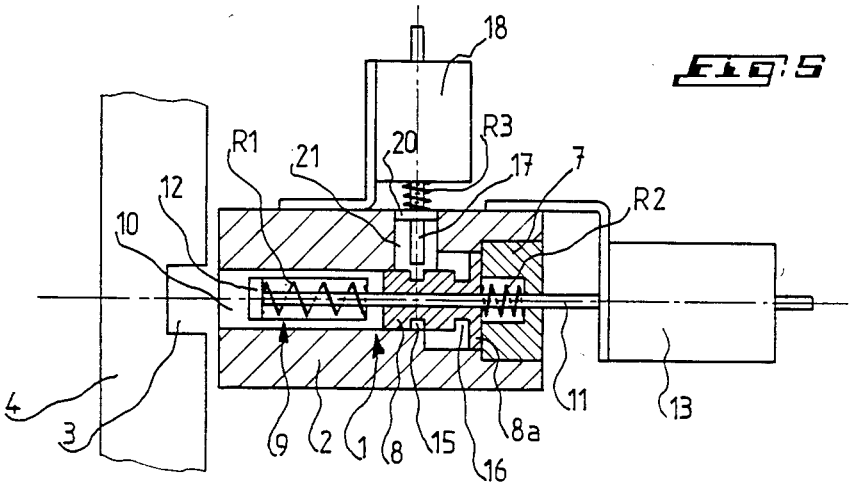
FIGS. 5 to 7 show the change from the unlocked state to the locked state.
Figure 6:
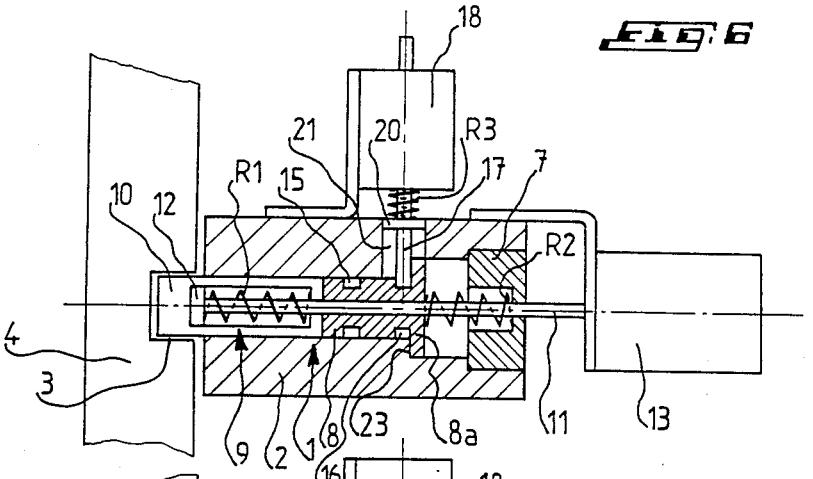
Figure 7:
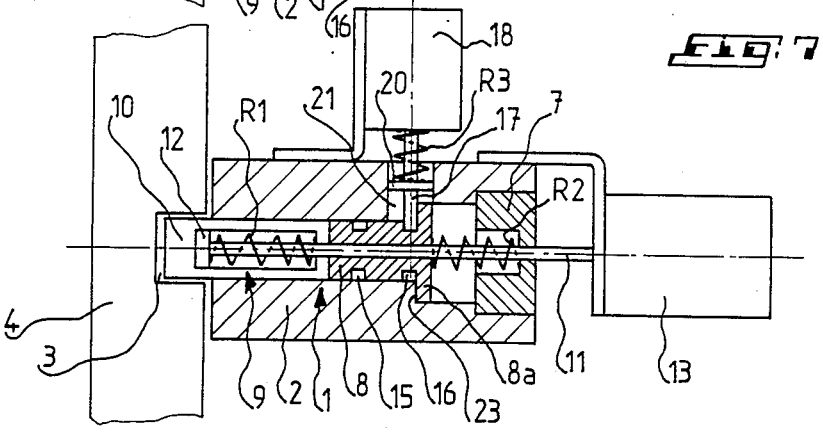

It should now be started from the position seen on FIG. 4 to explain the operation of the system when effecting the locking and this with reference in particular to FIGS. 5, 6 and 7.

The electromagnets 13 and 18 are energized simultaneously thereby causing the core 17 of the electromagnet 18 to move out of the groove 15 of the rear part 8 as seen on FIG. 5. It should be pointed out that the spring $R_2$ is compressed as well besides as the spring $R_3$.

Then, as seen on FIG. 6, the energizing of the electromagnet 13 is discontinued or switched out so that the spring $R_2$ is released and induces the leftward displacement of the rod 11 hence of the part 8-part 9 system constituting the bolt 1 which therefore engages the notch or keeper 3 of the bar 4. It should be pointed out that the stroke of the part 8 of the bolt 1 is stopped through abutment of the heel 8*a* of the part 8 against the shoulder 23 of the body 2.

At last, the energizing of the electromagnet 18 is discontinued and the core 17 is returned by the spring $R_3$ to the lower indexing position within the groove 16 of the part 8. Thus, the same condition as the one shown on FIG. 1 is restored or assumed again wherein the bolt 1 is locked thereby providing a positive locking of the bar 4. This means that any action by means of any tool upon the bolt 1 would be without any effect.

Figure 8:
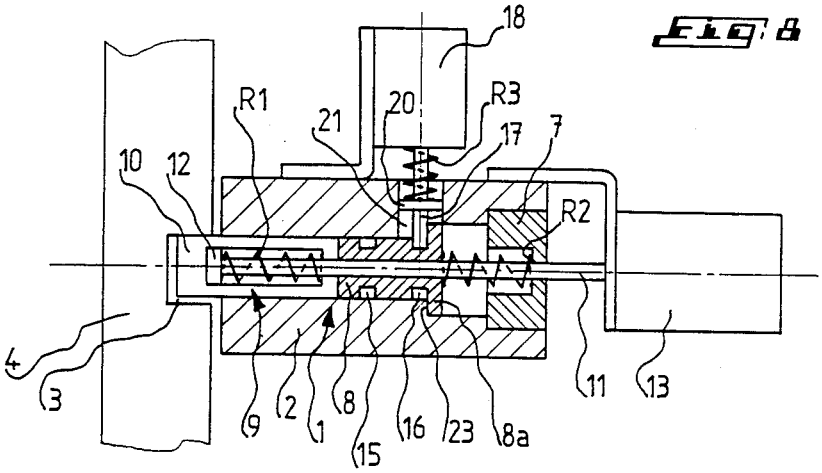
FIGS. 8 and 9 illustrate the operation of the device in case of the bolt becoming jammed within the keeper.
Figure 9:
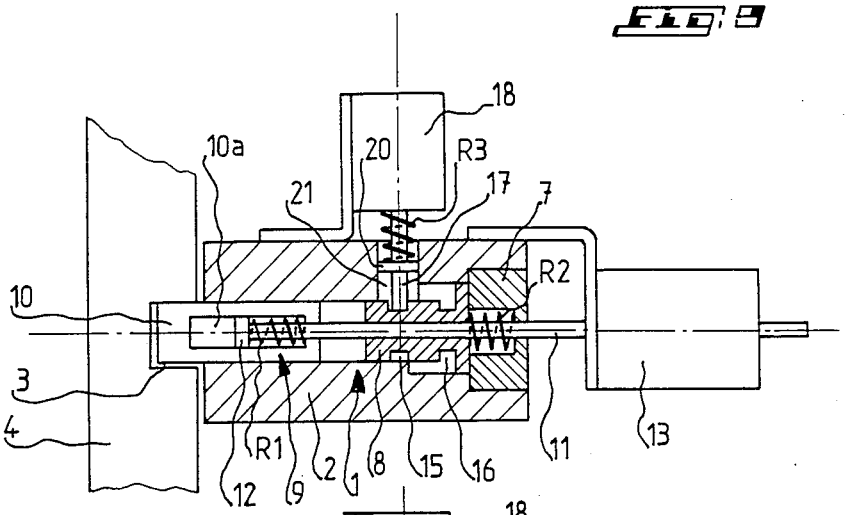

Reference should now be had to FIGS. 8 and 9 for briefly explaining the operation of the device in case of the front part 9 of the bolt 1 becoming jammed within the notch 3 of the bar 4.

This state is illustrated on FIG. 8 where it is seen that the wall of the notch 3 of the bar 4 is bearing upon the front portion 9 of the bolt 1.

For performing the unlocking, the sequence of the operating steps described with reference to FIGS. 2 to 4 is carried out. In other terms, the condition shown on FIG. 9 corresponds to that shown on FIG. 4 but in this instance, the front portion 9 of the bolt has been left in the initial position jammed within the keeper 3, the spring $R_1$ being compressed and the free end of the element 10 being remote or spaced away from the stop 12 as well seen on FIG. 9. As soon as an action upon the bar 4 is effected to release the pressure of this bar upon the element 10, this element will automatically assume again its position retracted into the body 2 under the effect of the spring $R_1$ which will release itself. The arrangement will therefore assume again the position seen on FIG. 4 wherein the bar 4 has been unlocked.

Figure 10:
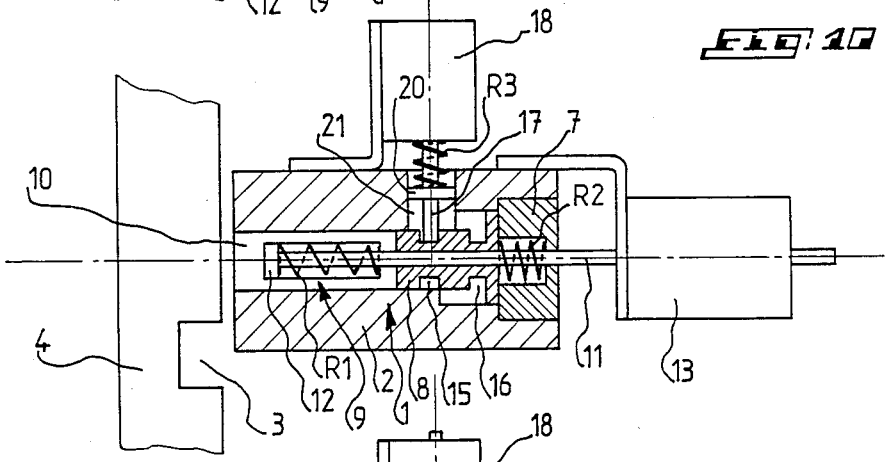
FIGS. 10 and 11 illustrate the operation of the device in case of a misalignment of the bolt with the keeper.
Figure 11:
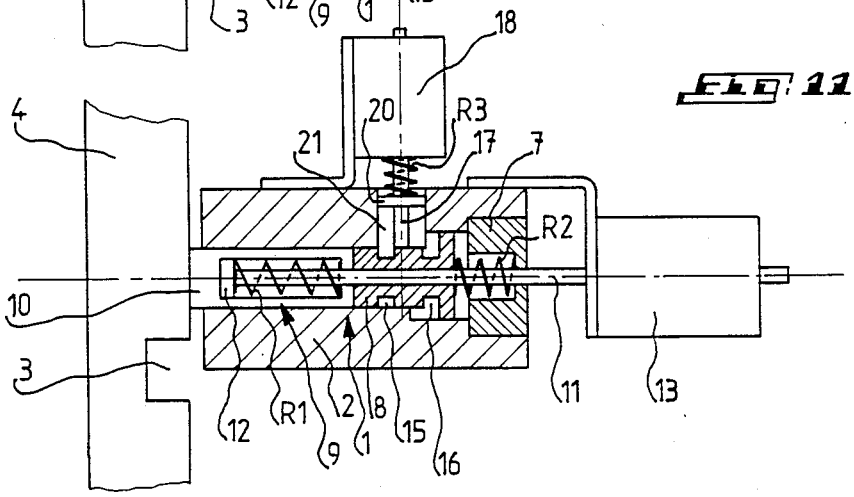

Reference should now be made to FIGS. 10 and 11 to explain the operation of the device in case of a misalignment of the bolt 1 with the keeper 3 as well seen on FIG. 10 wherein it is seen that the bar 4 is wrongly positioned with respect to the front portion 9 of the bolt 1.

The locking cycle may be carried out as explained with reference to FIGS. 5 to 7 but, in this instance, as seen on FIG. 11, the element 10 of the bolt is not engaging the notch 3 of the bar 4 and is caused to abut against this bar while being squeezed by the spring $R_2$. It is seen here that the core 17 of the electromagnet 18 is bearing upon the rear part 8 of the bolt 1 between both grooves 15 and 16. Once the bar 4 is in adequate position, i.e. the notch 3 will be in front of or in registering relationship with the element 10, this element will move into the notch under the effect of the compression of the spring $R_2$ and the locking of the bolt 1 will be achieved by the core 17 of the electromagnet 18 moving into the groove 16 of the rear part 8 of the bolt 1. The appliance will therefore be again in the state seen on FIG. 7.

There has thus been provided according to the invention, a locking and unlocking device which would consume just a minimal amount of electric current thereby allowing the bolt to be locked or held against motion in the locked and unlocked positions, respectively, and which removes the inconveniences resulting from a jamming and misalignment of the bolt with respect to the member to be locked.

This invention is of course not at all limited to the embodiment described and shown which has been given by way of example only.

The invention, on the contrary, comprises all the technical equivalents of the means described as well as their combinations if same are carried out according to its gist.

What is claimed is:

1. A device for locking or unlocking a member, comprising:

a bolt (1) slidably mounted within a body (2) and actuated by a first electromagnet (13) allowing said bolt to co-operate with a notch or keeper (3) provided within a member;

a second electromagnet (18) acting upon said bolt in order to block said bolt within said body when said bolt is in an inserted or non-inserted position within said keeper (3);

said bolt (1) comprising a rear part (8) having on its periphery two spaced annular grooves (15, 16) whereas said second electromagnet (18) includes one core (17) co-operating with said grooves to block said bolt in said inserted or non-inserted position, respectively;

said bolt (1) comprises a bored hollow forward end (10) adapted to co-operate with said keeper (3) and movably mounted within said body (2) with respect to said rear part (8) whereas said first electromagnet (13) includes one core or rod (11) secured to and extending through the rear part (8) of the bolt and having a free end adapted to slide within said hollow forward end (10); and said free end comprises a stop member (12) slidably mounted in the bore (10*a*) of said forward end (10), whereas a spring ($R_1$) is provided in said bore around said rod (11) between said stop member (12) and a rear portion (10*b*) said forward end to constantly act upon the latter in a position bearing against said stop member;

whereby inconveniences resulting from jamming and misalignment of the bolt with respect to the member to be locked are eliminated.

2. A device according to claim 1, further comprising:

a second spring ($R_2$) surrounding said rod (11), and said body (2) includes an end wall portion (7) with said second spring bearing against the rear part (8) of the bolt and said end portion.

3. A device according to claim 2, further comprising:

a third spring ($R_3$) urging the core (17) of said second electromagnet (18) towards the rear part (8) of the bolt.

4. A device according to claim 1, wherein both electromagnets (13, 18) are electrically connected so as to be selectively energizable or de-energizable: and said first electromagnet (13) is externally secured onto said body (2) in coaxial relationship therewith, whereas said second electromagnet (18) is externally fastened onto said body so that its core (17) extends at a substantially right angle to a center line axis of said body and through a bore (21) provided in said body and opening towards the rear part (8) of the bolt.

* * * * *